US005143006A

United States Patent [19]

Jimenez

[11] Patent Number: 5,143,006

[45] Date of Patent: Sep. 1, 1992

[54] ASSEMBLY FOR DETACHABLY MOUNTING A TOOL ON A DRIVING MEMBER

[75] Inventor: Antonio Jimenez, Meyrin, Switzerland

[73] Assignee: Mefina S.A., Switzerland

[21] Appl. No.: 689,818

[22] PCT Filed: Oct. 10, 1990

[86] PCT No.: PCT/CH90/00239

§ 371 Date: Jun. 13, 1991

§ 102(e) Date: Jun. 13, 1991

[87] PCT Pub. No.: WO91/05900

PCT Pub. Date: May 2, 1991

[30] Foreign Application Priority Data

Oct. 13, 1989 [CH] Switzerland ..... 03742/89
Oct. 13, 1989 [CH] Switzerland ..... 03743/89

[51] Int. Cl.[5] ..... D05B 55/02; D05B 29/12

[52] U.S. Cl. ..... 112/226; 112/240; 279/9.1

[58] Field of Search ..... 112/226, 236, 240; 279/1 R, 89, 9 R; 403/329, 330, 353, 362

[56] References Cited

U.S. PATENT DOCUMENTS 1,899,303 2/1933 Basso .
2,300,499 11/1942 Gookin .
2,823,379 2/1958 Novak ..... 403/330 X
2,878,765 3/1959 Gegauf .
2,985,127 5/1961 Reeber et al. .
3,344,761 10/1967 Ross .
3,457,889 7/1969 Killinger et al. ..... 112/240
3,587,498 6/1971 Wayne .
4,213,411 7/1980 Knowles ..... 112/240
4,359,955 11/1982 Hida .
4,577,837 3/1986 Berg et al. ..... 403/330 X
4,993,336 2/1991 Mizunuma ..... 112/226
5,042,406 8/1991 Jimenez et al. .

FOREIGN PATENT DOCUMENTS 0378965 7/1990 European Pat. Off. .
72170 11/1892 Fed. Rep. of Germany .
298848 5/1954 Switzerland .
362301 7/1962 Switzerland .

*Primary Examiner*—Werner H. Schroeder
*Assistant Examiner*—Paul C. Lewis
*Attorney, Agent, or Firm*—Cushman, Darby & Cushman

[57] ABSTRACT

An assembly for detachably mounting a tool such as a drill, a punch or a needle for a sewing machine on a driving member. The assembly includes a tool carrier, a mounting head for connecting the tool carrier to the driving member having at least one seat surface being cooperatively engaged with a corresponding portion of the tool carrier, a device for holding the tool carrier in contact with the seat, and positioning element to place the mounting head in a specific position relative to the tool carrier when the tool carrier is held by the holding device. The positioning element includes at least one stop member preventing displacement of the tool carrier on the seat, abutment members disposed in a specific direction for preventing displacement of the tool carrier on the seat in any path transverse to the direction, and at least one thrust member acting on the tool carrier in the direction for holding the tool carrier in permanent contact with the stop member in the specific position with respect to said mounting head.

15 Claims, 4 Drawing Sheets

FIG. 1
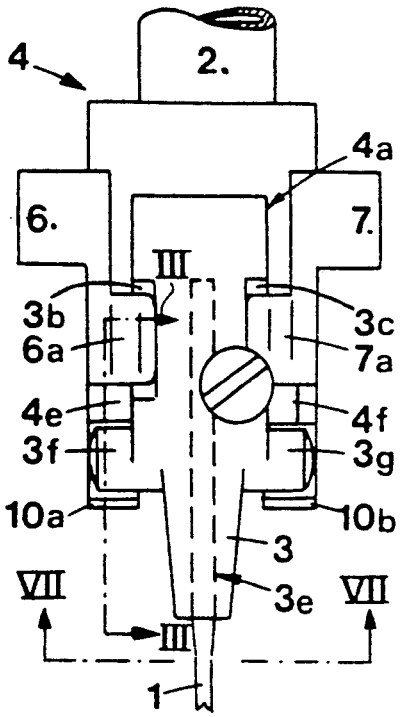
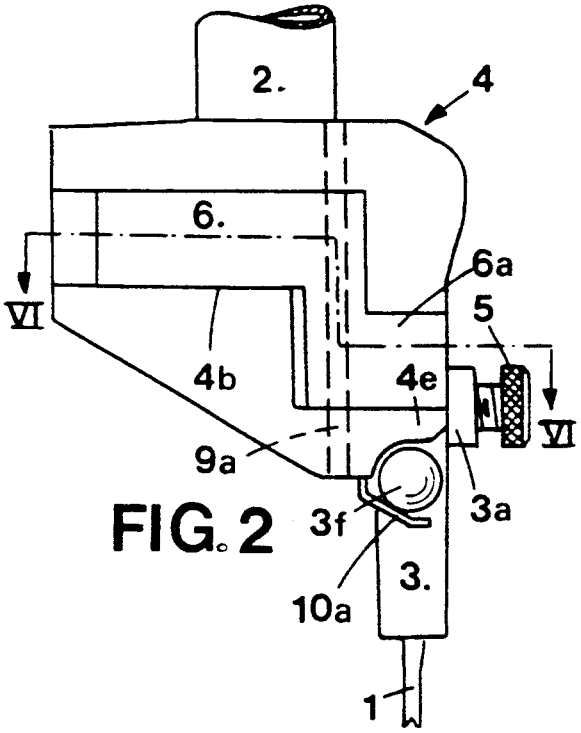
FIG. 2
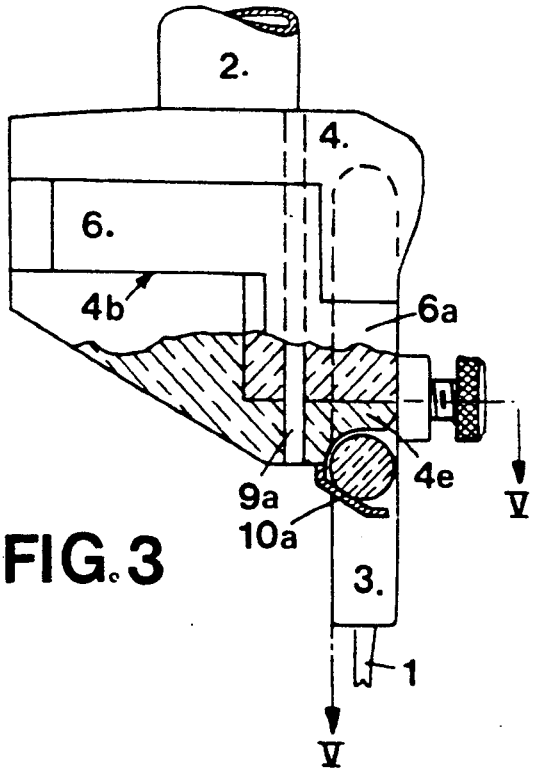
FIG. 3
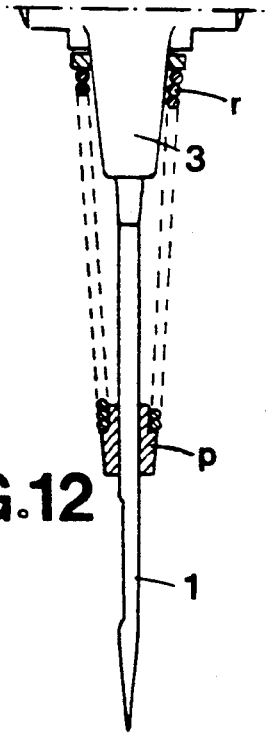
FIG. 12

FIG.5
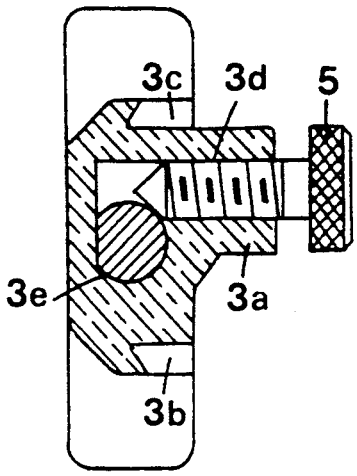
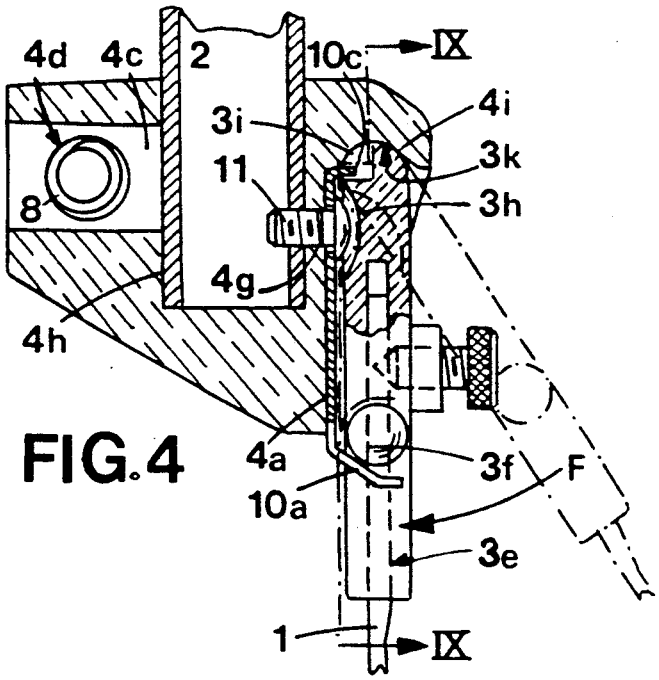
FIG.4
FIG.6
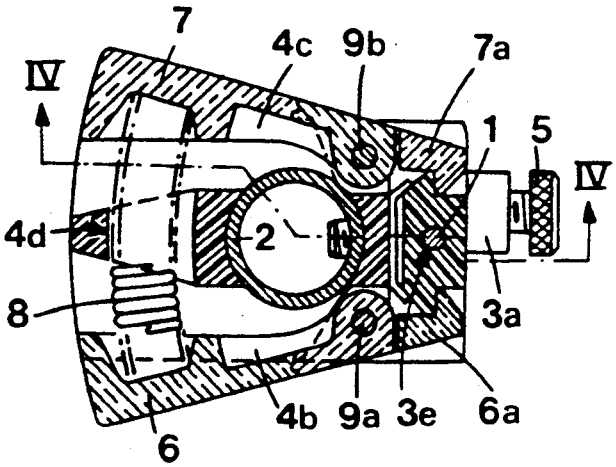
FIG.7
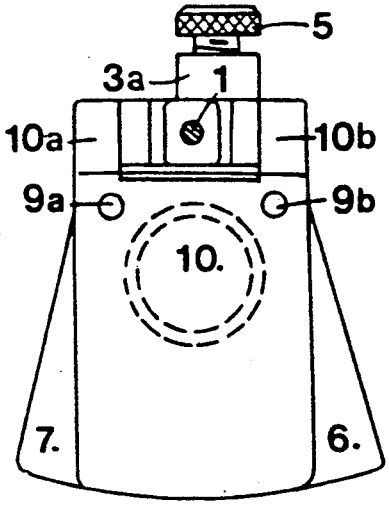

ASSEMBLY FOR DETACHABLY MOUNTING A TOOL ON A DRIVING MEMBER

The mounting of tools of very small size, for example drills, punches, needles or any other types of elongate parts, of diameter of the order of 1 mm, or even less, on a driving member, for example a spindle or a needle-bar, in the case of sewing machines or embroidering machines, and in a particularly precisely predetermined position, presents a significant difficulty for many people.

This difficulty arises in particular from awkward manipulation due to the smallness of such objects, and, very often, due to to their shape, which is generally very pointed, hence the potential risk which users may encounter of unpleasant wounds, even dangerous wounds if these objects are rusted.

To this must be added that not everybody is capable of effecting such mounting repeatedly with the precision and speed desired.

The above remarks also apply in the case of replacing one tool by another, in particular when the tool breaks or for the subsequent carrying out of other types of work rendering such a replacement necessary.

Finally, in consideration of the dimensions of the tools in question, which are frequently very small, as in the case of sewing needles, it is obviously difficult to characterise their nature by inscriptions, signs or ideograms that are sufficiently visible, or even complete.

In regard to the field of sewing machines and that of embroidering machines, it may be added that the hole provided for insertion of a needle in the clamp with which the bar is provided very often occupies a position, access to which is relatively difficult, so that it is not uncommon to see users either place the needle into this hole in an angular disposition which is incorrect, or to fail to introduce it completely into the hole.

In regard to the risk of injuring oneself, mentioned above, this arises in paricular in the case of machines having a plurality of needle bars disposed side by side, as is the case in embroidering machines as well as in certain sewing machines, both of the industrial type and the non-industrial type.

Attempts have already been made to obviate the foregoing disadvantages, in particular in the field of sewing machines, by the provision of constructions as numerous as they are varied relating both to the mounting of needles on the needle bar of the machine as well as to the mounting of the presser foot on its support. In particular, such constructions form the subject of Swiss Patent No. 362,301 and U.S. Pat. Nos. 4,359,955; 3,587,498; 3,344,761; 2,985,127; 2,878,765; 2,300,499 and 1,899,303.

The present invention relates more particularly to an assembly for detachably mounting a tool on a driving member of the type described in this last-mentioned document, that is to say an assembly comprising a tool carrier, a mounting head for the tool carrier intended to be connected to said driving member and comprising at least one seat for a corresponding portion of the tool carrier, a device for holding the tool carrier in contact with said portion of the seat, and means establishing, in an univocal manner, the relative position of the mounting head and the tool carrier when the latter is secured to the holding device, an assembly in which said means for univocal positioning comprises at least one stop member preventing any displacement of the tool carrier on the seat, at least in one specific direction, abutment members preventing any displacement of the tool carrier on said seat in any path whatever transverse to said specific direction, and at least one thrust member acting on the tool carrier in the direction for holding it in permanent contact with said stop member, that is to say in said unequivocal position with respect to the mounting head.

In addition to enabling the various disadvantages recited above to be obviated, the assembly according to the invention is especially well suited to miniaturization of the mounting head, and in particular to miniaturization of the tool carrier, which is hardly the case for the device forming the subject of U.S. Pat. No. 1,899,303. In particular, a tool carrier of this kind will have dimensions of an extent comparable to that of the tool, in particular a sewing needle, thus dimensioms which are very small, while yet being sufficient to enable easy engagement by a user's fingers.

The essential characteristics of the assembly according to the invention form the subject of claims 1 to 14.

The accompanying drawings depict, by way of example, an embodiment and variants of an assembly of this kind applied to the field of sewing machines or embroidering machines.

FIG. 1 is a front elevation;

FIG. 2 is a side view;

FIG. 3 is a view similar to that of FIG. 2 with part cut away on the line III—III of FIG. 1;

FIG. 4 is a sectional view along the axis IV—IV of FIG. 6;

FIG. 5 is a detailed section, on the line V—V of FIG. 3;

FIG. 6 is a section on the line VI—VI of FIG. 2;

FIG. 7 is a view from below, on the line VII—VII of FIG. 1;

FIG. 12 is a front view of another variant in embodiment of a part of the foregoing kind;

Figure 8:
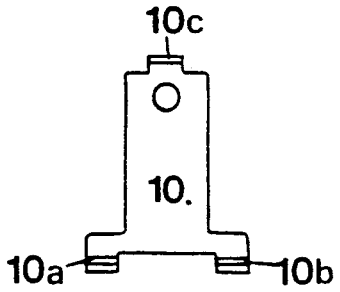
FIG. 8 is a front view of an element of FIG. 4.
Figure 9:
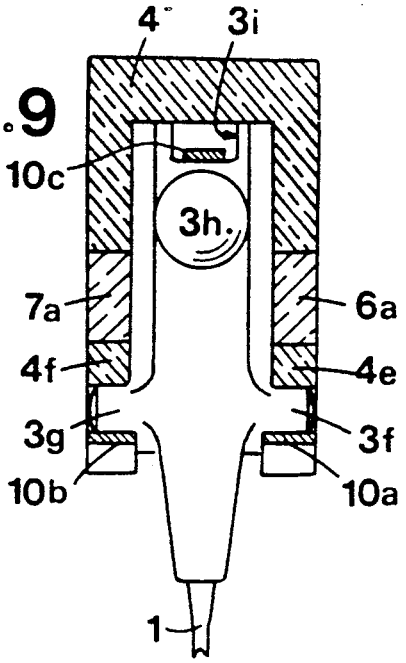
FIG. 9 is a section on the line IX—IX of this FIG. 4.

The assembly depicted in the drawings is intended to ensure the detachable mounting of an elongate part, for example a sewing needle, of which only the upper section, 1, is visible in the drawing, at the lower end of a needle bar 2 of a sewing machine or an embroidering machine, partially illustrated.

The functional elements comprised in such an assembly are nevertheless such that the assembly is perfectly adapted to support all types of "tools", even of small size, and thus may be the subject of applications as diverse as they are numerous, in particular all those in which a tool must be capable of being rapidly and detachably secured to a support, in a predetermined position, with especially high precision, by a simple manual action.

Thus, even though the description which follows will concern one application of the principle of the invention to a sewing machine or an embroidering machine, it should be understood that the structural elements which will be described may be adapted, with respect to their shape, their dimensions or also the materials from which they are formed, for any other practical application which would, by its nature, be capable of giving rise to the disadvantages noted above.

Essentially, the assembly depicted comprises a tool carrier and a mounting head generically indicated by the references 3 and 4 respectively (FIGS. 1 and 2).

The tool carrier 3 is formed here by a plate whose general shape is elongate, partially rectangular, of synthetic material for example, whose front surface, in the drawing, has, on the one hand, a boss 3*a*, disposed in a position slightly off centre to the right with respect to the longitudinal axis of symmetry of the plate (FIG. 1), and, on the other hand, two rectangular notches 3*b* and 3*c* provided along the left and right edges, respectively, of the plate. The function of the notches 3*b* and 3*c* will become clear subsequently.

In regard to the boss 3*a*, this is traversed by a threaded passage 3*d*, communicating with a straight blind hole 3*e* (FIGS. 1 and 5) into which the punch 1 is inserted. The end of a screw 5, engaged in the passage 3*d*, enables the punch to be jammed in position axially. As a result, the punch is detachably mounted in the tool carrier 3 and may thus easily be replaced by simply unscrewing the screw 5 and rescrewing it subsequent to the insertion of another punch, for example, in the hole 3*e*.

Below the boss 3*a*, the tool carrier has two cylindrical studs 3*f* and 3*g* extending out symmetrically, one from each side of the plate 3, the function of which will become clear subsequently.

On the upper part of its rear surface, the tool carrier has, on the one hand, a dished recess, 3*h*, and, on the other hand, an indentation 3*i*.

It may be noted, moreover, that the upper edge 3*k* of the tool carrier 3 has a semi-circular cross-sectional shape over its entire length.

In the mounted position on the head 4, the rectangular part of the tool carrier 3 is engaged in a seat of corresponding shape, 4*a*, cut out in the front surface of the head (FIGS. 1 and 4), a seat in which the tool carrier is jammed by the action of two gripping jaws 6*a* and 7*a* coming to take up positions in the previously-mentioned notches 3*b* and 3*c*, under the action of a spring 8 compressed between the rear ends of two levers 6 and 7, the gripping jaws forming the front ends of these levers (FIGS. 1 and 6).

As may be seen in the drawings FIGS. 2 and 6), the levers 6 and 7 are partially engaged in corresponding indentations 4*b* and 4*c*, provided on the side surfaces of the head 4 and communicating, at the rear of the head, by a window 4*d* allowing passage of the spring 8.

These levers are hinged on vertical pins 9*a* and 9*b* (FIGS. 2, 3, 6 and 7) driven into corresponding openings provided in the body of the head 4 and traversing respectively the indentation 4*b*, for the first pin, and the indentation 4*c*, for the second (FIGS. 3 and 6).

It should, at this point, be noted that the frontal portion of the gripping jaws 6*a* and 7*a* is indented in a slightly rounded bevelled shape; in a corresponding manner, the rear portion of the side surfaces of the tool carrier 3 also has a bevelled shape of similar inclination (FIG. 6).

This particular configuration, both for the gripping jaws 6*a* and 7*a* and for the tool carrier, is essentially intended to permit, as needed, control of the separation of the gripping jaws during the introduction of the tool carrier into the seat 4*a* of the head 4; in effect, when the bevelled portions of the tool carrier are brought into contact with the gripping jaws 6*a* and 7*a*, it suffices to exercise a slight pressure on the tool carrier for these gripping jaws to separate in opposition to the action of the previously-mentioned spring 8 and allow the tool carrier to engage in the seat 4*a* of the head 4.

It may be noted, moreover, that the height of the gripping jaws 6*a* and 7*a* (FIG. 1) is less than the length of the two rectangular notches (3*b*, 3*c*) with which the tool carrier 3 is provided.

Thus, in the embodiment depicted, these gripping jaws only in fact ensure retention of the tool carrier on the head but not its positioning; this latter is the result of the cooperation of various elements which will now be described.

The previously mentioned indentations 4*b* and 4*c* define, in effect, two overlays 4*e* and 4*f* (FIG. 1) whose lower surface has a partially rounded shape and which delimits, each in co-operation with one of two foot portions 10*a* and 10*b* of a blade spring 10, a recess in which the cylindrical stud 3*f* of the tool carrier 3 takes up position, between the overlay 4*e* and the foot portion 10*a*, and a recess in which the stud 3*g* takes up position, between the overlay 4*f* and the foot portion 10*b* of the blade spring 10 (FIGS. 1 to 3, 8 and 9).

This blade 10 is mounted on the underside of the seat 4*a* of the head 4 by a screw 11 engaged in a threaded passage 4*g* provided in the head and communicating with a vertical opening 4*h* into which the lower end of the spindle 2 is introduced. It may be noted that the screw 11 also serves for securing this spindle in the opening 4*h* of the head 4.

In its upper portion, the blade 10 has, moreover, a curved tongue 10*c*, which engages in the indentation 3*i* of the tool carrier 3, when this is positioned as illustrated in FIG. 4.

It may also be noted that the upper edge of the recess forming the seat 4*a* of the head 4 is formed by the base of a groove 4*i*, of semi-cylindrical shape and of radius corresponding to that of the upper edge 3*k* of the tool carrier 3.

Furthermore, and as may be seen clearly from FIG. 4, the difference in level between the upper portion of the edge 3*k* and the upper portion of the one or the other of the cylindrical studs (3*f* and 3*g*) of the plate 3 corresponds substantially to the difference in level between the portion of the base of the groove 4*i* occupying the most raised position and the horizontal portion of the lower surface of the overlays 4*e* and 4*f*.

Because of this, the introduction of the tool carrier 3 into the seat 4*a* of the head 4 may be carried out in a sure and easy manner: it suffices, in effect, to start by placing the tool carrier in the inclined position indicated in broken lines in FIG. 4 by insertion of its upper curved edge into the groove 4*i* of the head 4.

The tool carrier is then tilted in the direction F (FIG. 4) while separating the gripping jaws 6*a* and 7*a*, either by proceeding in the manner already described, or by tightening the levers 6 and 7 in opposition to the action of the spring 8, then releasing the levers as soon as the tool carrier reaches the vertical position shown in the drawing in which the studs 3*f* and 3*g* take up position between the overlays 4*e* and 4*f* and the foot portions 10*a* and 10*b* of the blade spring 10. It should be noted that these foot portions are shaped in such a manner that they are then slightly flexed in a clockwise direction such that they exercise a light vertical pressure on the tool carrier, thus assuring maintenance of the tool carrier in a perfectly defined axial position, resting against the base of the groove 4*i*.

Furthermore, precisely because, once the tool carrier 3 is attached to the head 4 in the manner described above, the foot portions 10*a* and 10*b* of the blade spring 10 are resiliently flexed, as soon as the gripping jaws 6*a* and 7*a* are opened by action on the levers 6 and 7, these foot portions relax and allow for lateral ejection of the tool carrier 3 and the tool 1 which is connected to it.

Even though in the preceding description, there has only been envisaged the case where the gripping jaws of the head 4 only have the function of ensuring the holding of the tool carrier in a position which is determined by the engagement of the upper edge 3*k* of the tool carrier in the groove 4*i* of the head, on the one hand, and the resilient action exercised by the foot portions 10*a* and 10*b* on the studs 3*f* and 3*g*, on the other hand, it would be possible, in a variant not depicted, to entrust this function of positioning exclusively to the gripping jaws 6*a* and 7*a*; for this purpose, it would suffice to make the gripping jaws of a size such that they engage in the notches 3*b* and 3*c* without any play, the height of the former corresponding substantially to the length of the latter.

Figure 10:
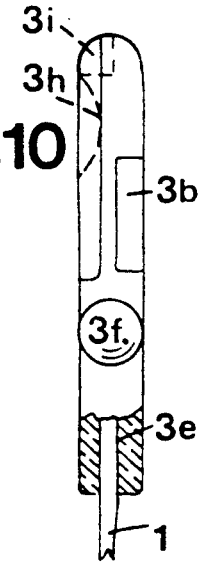
FIGS. 10, 11A and 11B illustrate variants of embodiments of an essential part of the assembly according to the invention.

In another variant for implementing the present invention (FIG. 10), the tool carrier and the tool may form a non-separable unit, the punch 1 being driven into the passage 3*e* of the tool carrier, or even secured in this passage by moulding, in particular if the tool carrier is formed from injection-moulded plastics material.

It should, at this point, be noted that, with an embodiment of this type, it is important to prevent the user from being able to mount the tool carrier backwards, that is to say with its front face turned towards the rear, in particular because, in such a situation, the mounting of the tool carrier in the seat of the head 4, solely by the action of the gripping jaws 6*a* and 7*a*, could only be imperfect.

This eventuality is rendered impossible by virtue of the presence of a "fail-safe device" formed by the tongue 10*c* of the blade spring 10 and by the indentation 3*i* with which the upper part of the tool carrier 3 is provided; if the tool carrier is engaged in the seat of the head 4 with its indentation 3*i* facing the head, the tongue 10*c* will enter into this indentation without opposing this engagement. If, on the contrary, an attempt is made to proceed in the same way while presenting the tool carrier reversed, that is to say in a position such that the indentation 3*i* is situated towards the front, the tool carrier will come up against the tongue 10*c* and cannot be engaged in the groove 4*i* of the head 4.

As a variant, the fail-safe device may be formed exclusively by the screw 11 projecting into the recess 3*h* of the plate.

In a more general manner, the fail-safe device may be formed by any element whatsoever projecting into the base of the seat 4*a* and by a corresponding recess provided on the back of the plate 3, a recess in which this element will take up position if the plate is inserted correctly; on the contrary, this element will form an obstacle to such an insertion if the user attempts to insert the plate in a reversed disposition.

It should also be noted that the user may take account visually of whether he is mounting the tool carrier the right way around or reversed; in effect the front surface of the tool carrier will generally be covered with inscriptions, signs or ideograms corresponding, for example, to a manufacturers' trade mark and/or an identification characteristic of the tool in question.

The positioning of the tool carrier 3 in the seat 4*a* of the head 4, in particular by initial engagement of the upper edge 3*k* in a groove 4*i* provided in the head, may be obtained, in a very similar manner, by configurations of the head quite different structurally from that described with reference to FIG. 4, in particular.

Figure 11A:
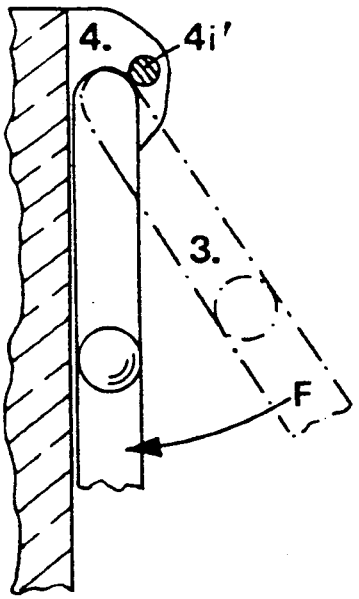

Thus, in the variant of embodiment of FIG. 11A, the seat intended for the tool carrier 3 is formed by a simple vertical surface provided on the front portion of the head 4 and the positioning of this tool carrier is ensured by contact of its upper edge with a horizontal pin 4*i'*, fixed to the head 4, attached to this at a distance from the seat which is less than the thickness of the tool carrier.

As may be seen in the drawing, this very simple architecture permits mounting the tool carrier 3 on the head 4 in the same manner as already described, that is to say by first of all placing the tool carrier in the position illustrated in dash and point lines and by tilting it in a clockwise direction while keeping it in constant contact with the pin 4*i'*.

Figure 11B:
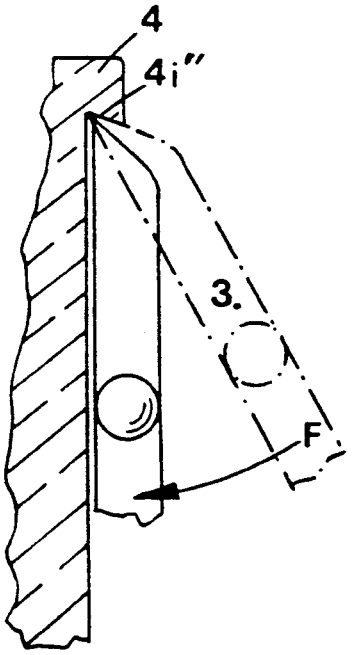

In the variant of FIG. 11B, the upper edge of the tool carrier 3 is bevelled and is intended to be engaged in a groove 4*i''* of substantially triangular cross-section, provided in the head 4, at the upper end of the seat intended to receive the tool carrier. This groove has an angular dimension of value greater than that of the inclination of the bevel which forms the upper edge of the tool carrier so as to permit, firstly, easy insertion of this edge (as in the representation in dash and point lines of the tool carrier) into the groove 4*i''* without having to first of all separate the gripping jaws 6*a* and 7*a*, then engagement without difficulty of the tool carrier 3 between the gripping jaws (a position illustrated in solid line).

It may be noted that by virtue of this particular type of construction, the tool carrier may not, in any case, be disposed reversed with respect to the disposition illustrated in FIG. 11B, the back of the bevelled portion of the tool carrier butting against the extreme right hand edge of the groove 4*i''*.

Of course other adaptations and shapes of the upper edge of the tool carrier 3 and of the blocking element (4*i*, 4*i'*, 4*i''*) for this on the head 4 are possible without however departing from the scope of the present invention.

Furthermore, it is evident that the holding of the tool carrier on the seat of the head may be ensured by some sort of detachable securing device, which may even be structurally very different from that formed by the levers 6 and 7, the gripping jaws which are associated with them and the tightening spring 8, such as is described with reference to the accompanying drawings.

Figure 13:
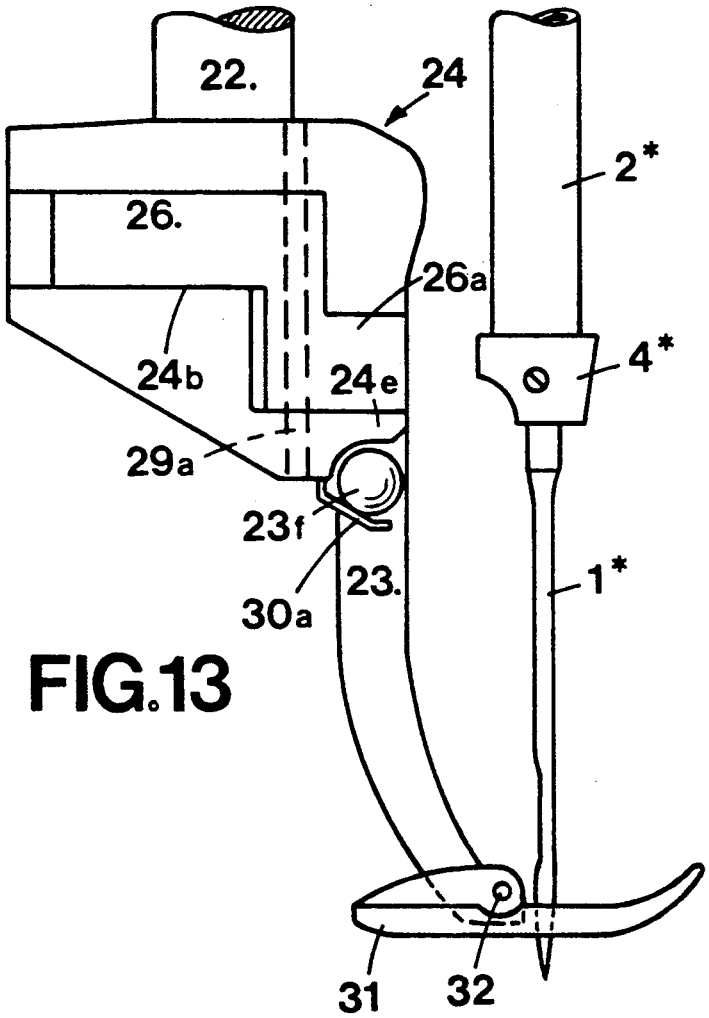
FIG. 13 is a side elevation showing another possible use for the assembly according to the invention.

Even though the preceding description and the drawings to which the description refers have only envisaged the case of mounting a needle of conventional type on a sewing machine or an embroidering machine, it may be noted that it is clear that the invention is not limited to a particular use of this kind and that it also enables the mounting of other types of tools, in particular "multiple" needles or "presser-foot" needles of the kind shown in FIG. 12 (the functional features of which are well known to the man skilled in the art, in particular from RFA Patent No. 72,170 and Swiss Patent No. 298,848), and even enables the mounting of the presser foot of the machine on a suitable support (FIG. 13).

In FIG. 12, the presser-foot p is formed by a bush, for example of synthetic material, slidingly mounted on the body of the needle 1 and subjected to the action of a spring r, which is tensioned between the presser-foot itself and the lower part of the needle bar 3.

In FIG. 13, there is seen a presser-foot comprising a sole bar 31 pivoted at 32 on a support 23, the upper part of which is shaped in a manner identical to that of the tool carrier 3 previously described, and which is mounted on an attachment head 24, whose structural parts correspond, in all aspects, to those of the mounting head 4, also described previously.

For this reason, the corresponding elements of the design appearing in FIG. 13 have been indicated by references corresponding to those shown in FIG. 2, with the addition of the quantity 20.

The attachment head 24 is mounted at the lower end of a vertical bar 22, which is shown in part and extends parallel to the needle bar 2* of the sewing machine, a bar provided, in conventional manner, with a clamp 4* to which a needle 1* is detachably secured.

It is however obvious that a mounting head of this kind may equally well be mounted on a support other than a bar such as the bar 22: it may, for example, be mounted at the free end of the lever 70, appearing in FIG. 1 of the drawings of U.S. Pat. No. 5,042,406 relating to "A presser-foot device for a sewing machine", published on Jul. 25, 1990, to which reference may be made for further details, or at the free end of the lever 170 shown in FIG. 7 of the drawings of the above application.

At this point, there should be emphasised a particularly important advantage capable of being obtained by the tool carrier depicted in FIGS. 1 to 9, in particular when the tool must be placed on the tool carrier in a very precise axial and/or angular position, which must be determined prior to its utilization, this being, for example, the case for a sewing maching or an embroidering machine. In effect, this setting may be carried out while the tool carrier has not yet been mounted on the spindle, which is particularly advantageous whenever such a spindle is inherently difficult to access. Furthermore, the user may form a reserve of the same tools, adapted in the same manner on tool carriers specific for each tool of the reserve and utilizable by way of spare parts without noticeable interruption of the operation to be carried out by the type of tool in question.

In a general manner, the assembly described and shown is particularly well suited to mounting, on a driving member, for example a needle bar, any other type of part which itself constitutes a tool, or, in a simpler manner, constitutes a mounting shaft for any kind of tool requiring to be connected, at least temporarily, to the driving member.

I claim:

1. Assembly for detachably mounting a tool on a driving member, comprising:

a tool carrier, a mounting head for connecting the tool carrier to the driving member, the mounting head including at least one seat surface being cooperatively engaged with a corresponding portion of the tool carrier, a device for holding the tool carrier in contact with the seat, and means for positioning the mounting head in a specific position relative to the tool carrier when the tool carrier is held by the holding device, the positioning means including:

at least one stop member preventing displacement of the tool carrier on the seat, abutment members disposed in a specific direction for preventing displacement of the tool carrier on the seat in any path transverse to said direction, and at least one thrust member acting on the tool carrier in a direction for holding the tool carrier in permanent contact with the stop member in said specific position with respect to said mounting head, said mounting head being formed by a body having at least a portion of an external surface hollowed out by a recess, said recess having a base, longitudinal side walls, a top wall and being open at one end thereof, at least a portion of the base of the recess forming said seat, at least a portion of the longitudinal side walls of the recess forming said abutment member, at least a portion of the top wall of the recess defining the other end of said recess forming said stop member, said tool carrier including a plate portion having a shape which substantially corresponds to the shape of said recess of the mounting head, a first end of said plate portion being in contact with said stop member.

2. Assembly according to claim 1, wherein the plate has a recess for receiving the tool, said recess opening on a second end of the plate opposite to said first end of the plate, the assembly further including means permitting detachable securing of the tool to the plate.

3. Assembly according to claim 1, wherein the plate has a recess in which the tool is engaged, said tool being formed integral with the plate by moulding material so as to form the plate onto at least a portion of the tool.

4. Assembly according to claim 2 or 3, wherein said thrust member is formed by at least one resilient member inserted between the body and a portion of the plate situated opposite to said first end of the plate, the resilient member being disposed in such a manner as to be brought to a stressed condition by action of the tool carrier when placed on the seat, in said specific position.

5. Assembly according to claim 4, wherein the plate has at least one stud projecting out from at least one surface of the plate, said resilient member engaging said at least one stud.

6. Assembly according to claim 5, wherein said resilient member is formed by a distal portion of a resilient blade covering at least a part of the base of the recess of the mounting head and being integral with said body.

7. Assembly according to claim 6, wherein the plate has two studs projecting outwardly therefrom, one stud being on each side surface of the plate, the blade comprises two resilient members adapted to co-operate with the first of said studs, for the first resilient member, and with the second stud for the other resilient member.

8. Assembly according to claim 1, further comprising at least one fail-safe device to prevent placing the plate in the recess of the body of the mounting head in a position different from said specific position.

9. Assembly according to claim 8, wherein the fail-safe device is formed by at least one projecting member provided at the base of the recess of the body of the mounting head, and by a cavity provided in the plate on a portion thereof occupying a position corresponding to that of the projecting member, the projecting member being capable of penetrating into the cavity when the plate is introduced into said recess in a position corresponding to said specific position.

10. Assembly according to claim 9, wherein the blade has a projecting tongue at the base of the recess of the mounting head and wherein the surface of the plate adapted to co-operate with said seat has an indentation disposed so as to enable free penetration of said tongue into the interior of the indentation, at least when the plate occupies said specific position.

11. Assembly according to claim 1, wherein the end of the plate intended to be brought in contact with the portion of the top wall of the recess of the mounting head forming said stop member has a semi-cylindrical profile, said portion of the top wall having a groove of a shape corresponding to that of said profile.

12. Assembly according to claim 1, wherein the holding device comprises at least one gripper joined to one of said tool carrier and said mounting head, for securing said tool carrier with at least a portion of said mounting head, at least one first resilient means effecting tightening of the gripper of sufficient intensity to ensure said securing action, and members which permit opening of the gripper in opposition to said resilient means in order to separate the tool carrier from the mounting head, by overcoming the securing action.

13. Assembly according to claim 12, wherein the gripper has gripping jaws and is joined to the body of the mounting head, the gripper being disposed in such a manner that, in an engaging position of the gripper, at least an end part of the gripping jaws of the gripper extends out from an interior of the recess of the mounting head, along the longitudinal walls of the recess, and wherein longitudinal edges of the tool carrier each have a slot, one of which receives the end projecting portion of a first gripping jaw, and the other of which receives a corresponding portion of a second gripping jaw of the gripper.

14. Assembly according to claim 1, wherein a surface of the plate opposite to that in contact with the seat of the mounting head is covered with at least one of inscriptions and ideograms descriptive of the tool to which it is joined.

15. Assembly according to claim 1, in combination with one of a sewing machine and an embroidering machine, said assembly being connected to one of a needle bar and a presserfoot device of said machine.

* * * * *